US005738550A

United States Patent [19]

Sakuraoka et al.

[11] Patent Number: 5,738,550

[45] Date of Patent: Apr. 14, 1998

[54] PRESS-FIT PIN FITTING IN A MINIATURIZED THROUGH HOLE FORMED IN A CIRCUIT BOARD

[75] Inventors: Masahiko Sakuraoka; Takeshi Okuyama; Hidehisa Sakai; Takeshi Nishiyama, all of Kawasaki, Japan

[73] Assignee: Fujitsu Limited, Kawasaki, Japan

[21] Appl. No.: 748,121

[22] Filed: Nov. 13, 1996

Related U.S. Application Data

[63] Continuation of Ser. No. 397,842, Mar. 2, 1995, abandoned.

[30] Foreign Application Priority Data

Mar. 4, 1994 [JP] Japan ..... 6-035078

[51] Int. Cl.[6] ..... H01R 13/42

[52] U.S. Cl. ..... 439/751

[58] Field of Search ..... 439/751, 79, 80, 439/81, 82

[56] References Cited

U.S. PATENT DOCUMENTS

| | | | |
|---|---|---|---|
| 4,762,498 | 8/1988 | Harting et al. | 439/751 |
| 4,795,378 | 1/1989 | Tomizu et al. | 439/751 |
| 4,878,861 | 11/1989 | Kendall et al. | 439/751 |
| 5,213,514 | 5/1993 | Arai | 439/79 |

FOREIGN PATENT DOCUMENTS

| | | | |
|---|---|---|---|
| 3220781 | 12/1983 | Germany | 439/751 |
| 3535074 | 4/1987 | Germany | 439/751 |
| 60-230372 | 11/1985 | Japan . | |
| 5-166556 | 7/1993 | Japan . | |

*Primary Examiner*—Neil Abrams
*Assistant Examiner*—T. C. Patel
*Attorney, Agent, or Firm*—Nikaido, Marmelstein, Murray & Oram LLP

[57] ABSTRACT

A press-fit pin has a press-fitting portion having a plurality of bending portions which are to be elastically bent so that a bending stress generated in the press-fitting portion is dispersed to the bending portions. The press-fitting portion is to be press fit into a through hole. The press-fitting portion has a plurality of beams extending along a longitudinal axis of the press-fitting portion. The beams are elastically bent along a line parallel to the longitudinal axis when the press-fitting portion is press fit into the through hole. The press-fitting portion has a cross portion extending along the longitudinal axis of the press-fitting portion so as to connect the beams. The cross portion is elastically bent along a line parallel to the longitudinal axis when the press-fitting portion is press fit into the thorough hole.

8 Claims, 11 Drawing Sheets

PRESS-FIT PIN FITTING IN A MINIATURIZED THROUGH HOLE FORMED IN A CIRCUIT BOARD

This application is a continuation of application Ser. No. 08/397,842 filed Mar. 2, 1995, now abandoned.

BACKGROUND OF THE INVENTION (1) Field of the Invention

The present invention relates to a press-fit pin, and more particularly to a press-fit pin used for a high-density printed circuit board of which a through hole for the press-fit pin is miniaturized.

In association with the recent tendency of circuit boards of being high density, a through hole formed in the circuit boards, into which a press-fit pin is inserted, is miniaturized in its diameter. A diameter of 0.64 mm had been used for the conventional through hole, but recently diameters of 0.52 mm have been used. The diameter of the through hole is expected to be as small as 0.48 mm in the near future.

(2) Description of the Relate Art

FIG. 1 shows a cross-sectional view of a press-fitting portion of a conventional press-fit pin described in Japanese Laid-Open Patent Application No. 60-230372, the cross-sectional view being perpendicular to a longitudinal axis of the press-fitting portion.

The press-fitting portion 10 comprises left and right extending portions 11 and 12 and a cross portion 13 connecting the left and right extending portions 11 and 12 to each other. The cross portion 13 is formed in such a shape that it is elastically bent, as shown in FIG. 1, with a lower side thereof being protruded. A chain line 14 of FIG. 1 indicates a center line of the cross portion 13.

Each of the extending portions 11 and 12 are formed in the shape of generally equilateral triangle, one of the edges being positioned on the cross portion 13. The extending portions are rigid, and thus they cannot be bent when the press-fitting portion is press fit into a through hole formed in a circuit board. Accordingly, the press-fitting portion 10 has only one portion which is elastically bent.

FIGS. 2A and 2B show states in which the press-fit pin is press fit into conventional through holes 20 and 21 formed in a circuit board. The through hole is formed with some tolerances, for example, ±0.04 mm. The through hole 20 is a hole close to the upper limit of tolerance, and the through hole 21 is a hole close to the lower limit of tolerance.

The press-fitting portion 10 is press fit into the through hole 20, as shown in FIG. 2A, so that only the cross portion 13 is elastically bent and the center line 14 becomes line **14*a* shown in the figure. Due to an elastic force F1 generated by the cross portion 13, the extending portions 11 and 12 press an inner surface of the through hole 20 with a force f1. By the force f1, the press-fitting portion 10 is retained in the through hole 20**.

The press-fitting portion 10 is press fit into the through hole 21, as shown in FIG. 2B, so that only the cross portion 13 is elastically bent more than that shown in FIG. 2A and the center line 14 becomes line **14*b* shown in the figure. Due to an elastic force F2 generated by the cross portion 13, the extending portions 11 and 12 press an inner surface of the through hole 21 with a force f2. By the force f2, the press-fitting portion 10 is retained in the through hole 21**.

When the diameter of the through hole is reduced to, for example to 0.48 mm, the press-fitting portion 10 of the press-fit pin is must be altered to correspond to the miniaturized reduced diameter of the through hole. On the other hand, accuracy of the dimensions of the press-fitting portion 10 manufactured using a present press forming method is close to its limit, and thus it is very difficult to obtain dimensions with increased accuracy for the press-fitting portion 10. Accordingly, even if the press-fitting portion 10 is miniaturized, the tolerance in dimension of the press-fitting portion 10 is not changed.

In the above-mentioned situation, a ratio of the tolerance b to the width a of the cross portion 13 (refer to FIG. 1) of the miniaturized press-fit pin becomes greater than that of the conventional press-fit pin, which condition effects on bending characteristic of the cross portion 13. That is, if the width a of the cross section 13 is reduced, a bending stress generated in the cross portion 13 is more tolerable.

Generally, in order to reduce the tolerance of a retaining force of the press-fit pin press fit in the through hole which tolerance is generated due to a tolerance in the diameter of the through hole, the press-fit pin is designed so that the cross portion 13 is bent close to a yield point of its bending-stress characteristic curve. Accordingly, if the press-fitting portion 10 of the miniaturized press-fit pin is press fit into a through hole having a smaller diameter but within the tolerance, the cross portion 13 may be bent to the extent in which the bending exceeds the yield point, and eventually the cross portion 13 may fracture.

If the cross portion 13 is bent beyond the yield point, the pressing force of the extending portions 11 and 12 to the inner surface of the thorough hole is reduced, and thus the retaining force of the press-fit pin is reduced. Further, if the cross portion 13 is bent to a fracture point, the cross portion 13 is broken which condition results in a state in which no pressing force to the inner surface of the through hole is exerted by the extending portions 11 and 12, and thereby the press-fit pin no longer functions.

As mentioned above, since the conventional press-fit pin is configured so that a bending stress is concentrated into the cross portion 13, there is a problem in that the effect of the tolerance in dimensions of the press-fit pin on the retaining force of the press-fit pin is increased when the dimensions of the press-fitting portion are reduced. In the worst case, there is a problem in that the cross portion 13 is broken when the press-fit pin is inserted into the through hole.

SUMMARY OF THE INVENTION

It is a general object of the present invention to provide a press-fit pin which eliminates the above-mentioned disadvantages.

A more specific object of the present invention is to provide a press-fit pin having a press-fitting portion having a plurality of bending portions which are to be elastically bent so that a bending stress generated in the press-fitting portion is dispersed to the bending portions.

In order to achieve the above-mentioned objects, there is provided according to the present invention a press-fit pin having a press-fitting portion to be press fit into a through hole, the press-fitting portion comprising:

a plurality of beams extending along a longitudinal axis of the press-fitting portion, the beams being elastically bent along a line parallel to the longitudinal axis when the press-fitting portion is press fit into the through hole; and a cross portion extending along the longitudinal axis of the press-fitting portion so as to connect the beams, the cross portion being elastically bent along a line parallel to the longitudinal axis when the press-fitting portion is press fit into the through hole.

According to the present invention, due to the bending of the beams, the amounts of the bending of the cross portion is less than that in a condition where the beams are not bent. Accordingly, even if the through hole has a minimum diameter in its tolerance, the bending of the beams and the cross portion does not reach the yield point, and thus a large margin is provided before the fracture point is reached. Therefore, the press-fitting portion of the press-fit pin according to the present invention does not fracture even if it is press fit into a minimum diameter through hole.

Other objects, features and advantages of the present invention will become more apparent from the following detailed description when read in conjunction with the accompanying drawings.

DETAILED DESCRIPTION OF THE PREFERRED EMBODIMENTS

Figure 1:
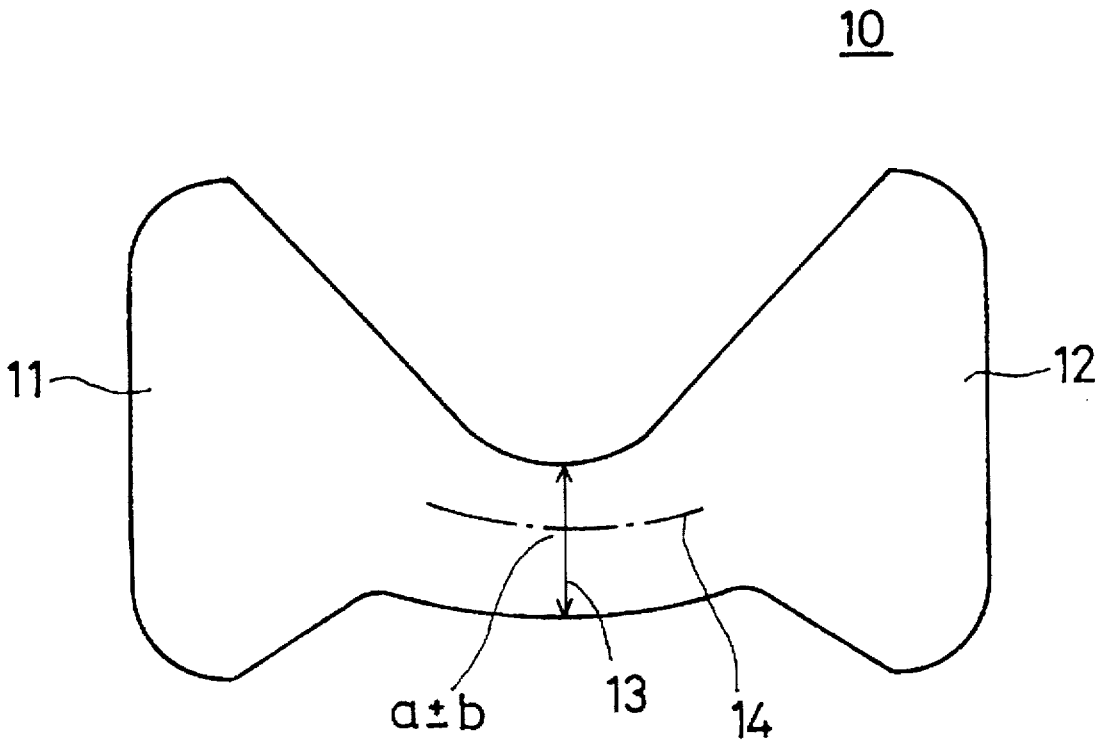
FIG. 1 PRIOR ART
FIG. 1 is an enlarged cross-sectional view of a press-fitting portion of a conventional press-fit pin.
Figure 2A:
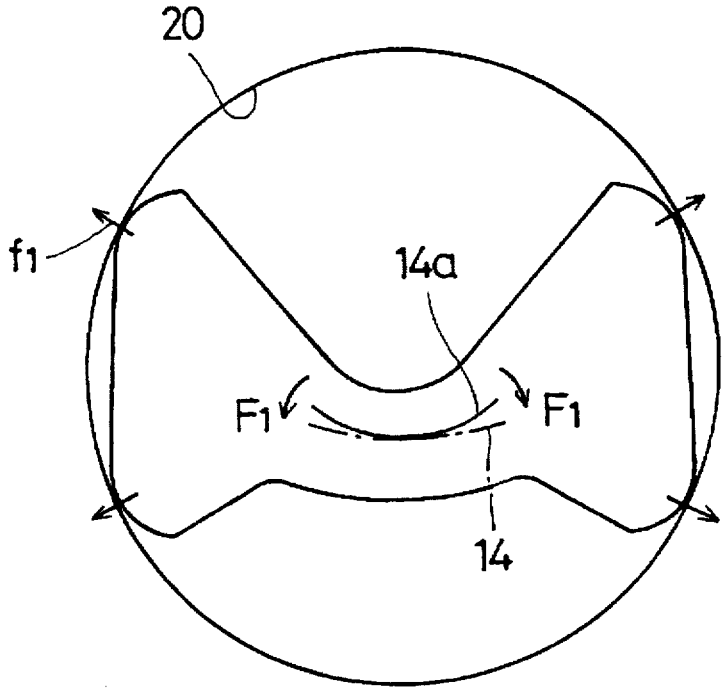
FIG. 2A PRIOR ART
FIGS. 2A and 2B are cross-sectional views of the press-fit pin shown in FIG. 1 in a state where the press-fit pin is press fit into a through hole.
Figure 2B:
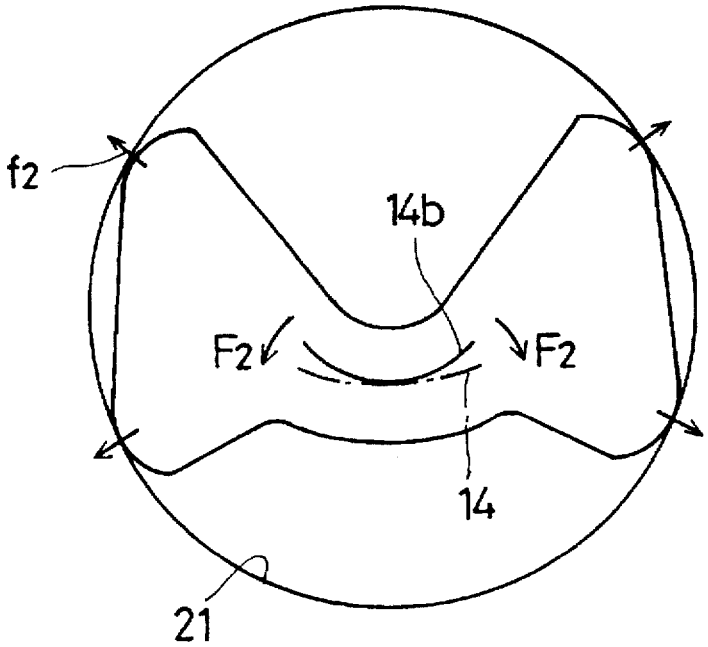
FIG. 2B PRIOR ART
Figure 3:
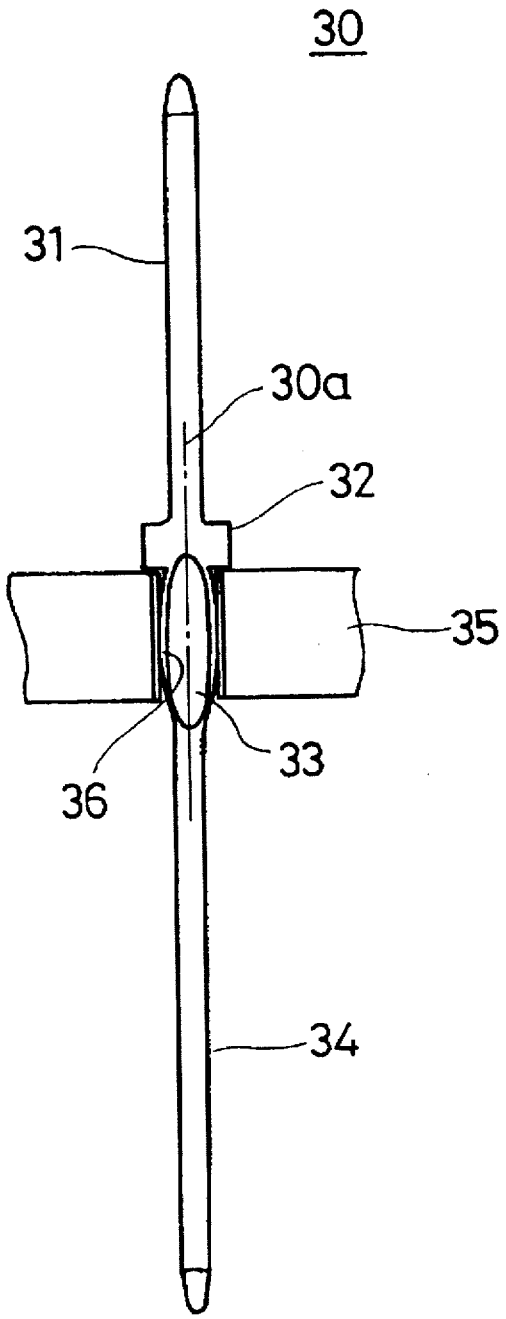
FIG. 3 is a front view of a first embodiment of a press-fit pin according to the present invention.

A description will now be given of a first embodiment of a press-fit pin according to the present invention. FIG. 3 shows a first embodiment of a press-fit pin 30 according to the present invention.

The press-fit pin 30 comprises a contacting portion 31, an engaging portion 32, a press-fitting portion 33 and a wire lapping portion 34, in that order starting from its top. The press-fit pin 30 is formed, similarly to the conventional press-fit pin, from a phosphor bronze plate by press punching, and a portion of its surface is plated. The press-fitting portion 33 is formed, when the press-fit pin is punched, by press machining using a pair of pressing dies so that both sides extend in opposite directions. The press-fit pin 30 is retained in a printed circuit board 35 by press-fitting the press-fitting portion 33 into a through hole 36 of the printed circuit board 35.

Figure 4:
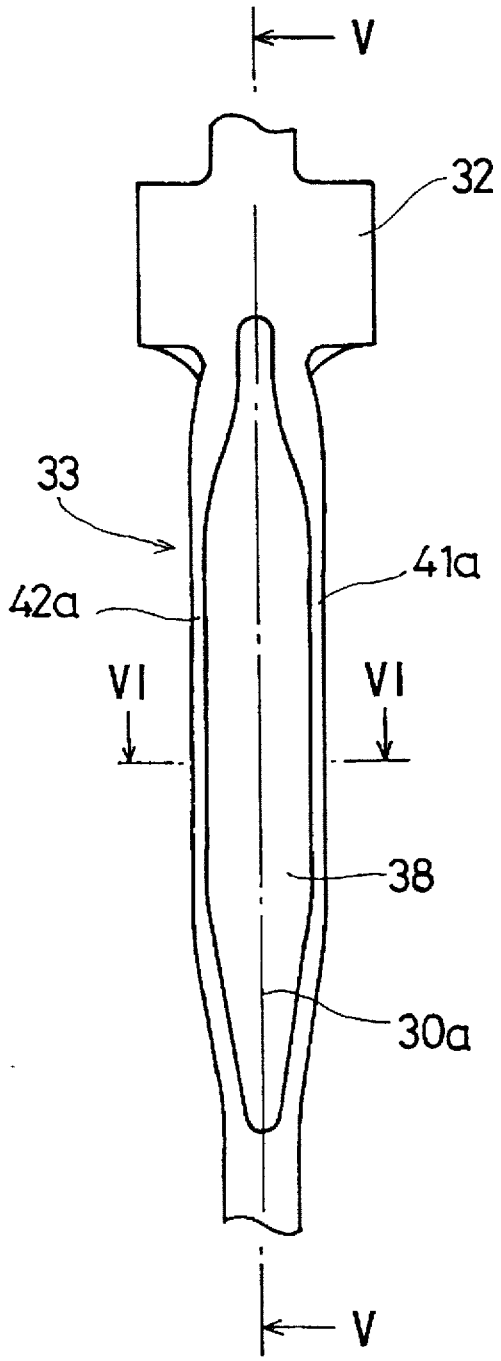
FIG. 4 is an enlarged view of a press-fitting portion of the press-fit pin shown in FIG. 3.
Figure 5:
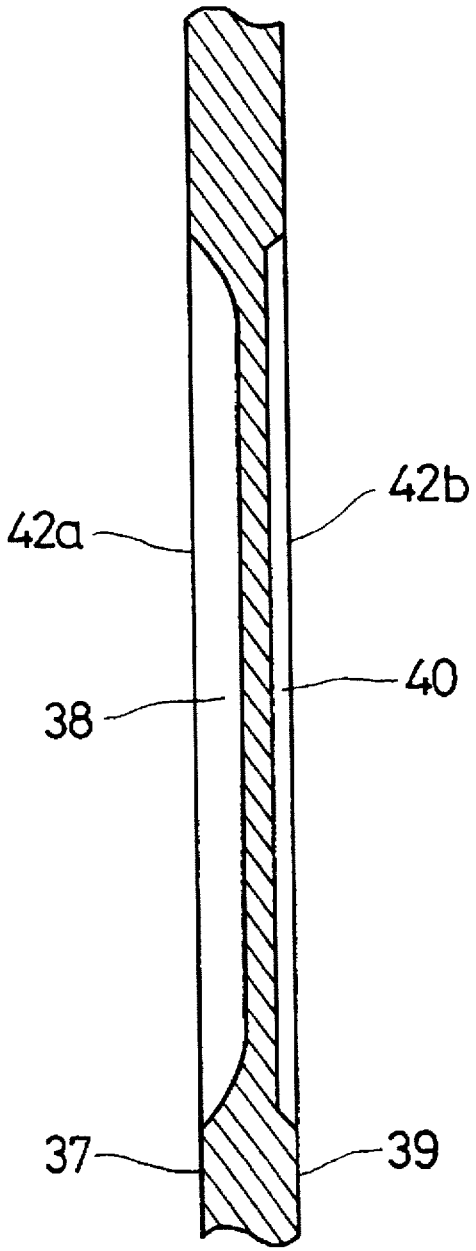
FIG. 5 is a cross-sectional view of the press-fitting portion taken along a line V—V of FIG. 4.

The press-fitting portion 33, as shown in FIGS. 4 and 5, comprises elongated recesses 38 and 40. The elongated recess 38 is formed on a front surface of the press-fitting portion 33 by press machining. The elongated recess 40 is formed on a back side of the press-fitting portion 33 by press machining.

Figure 6:
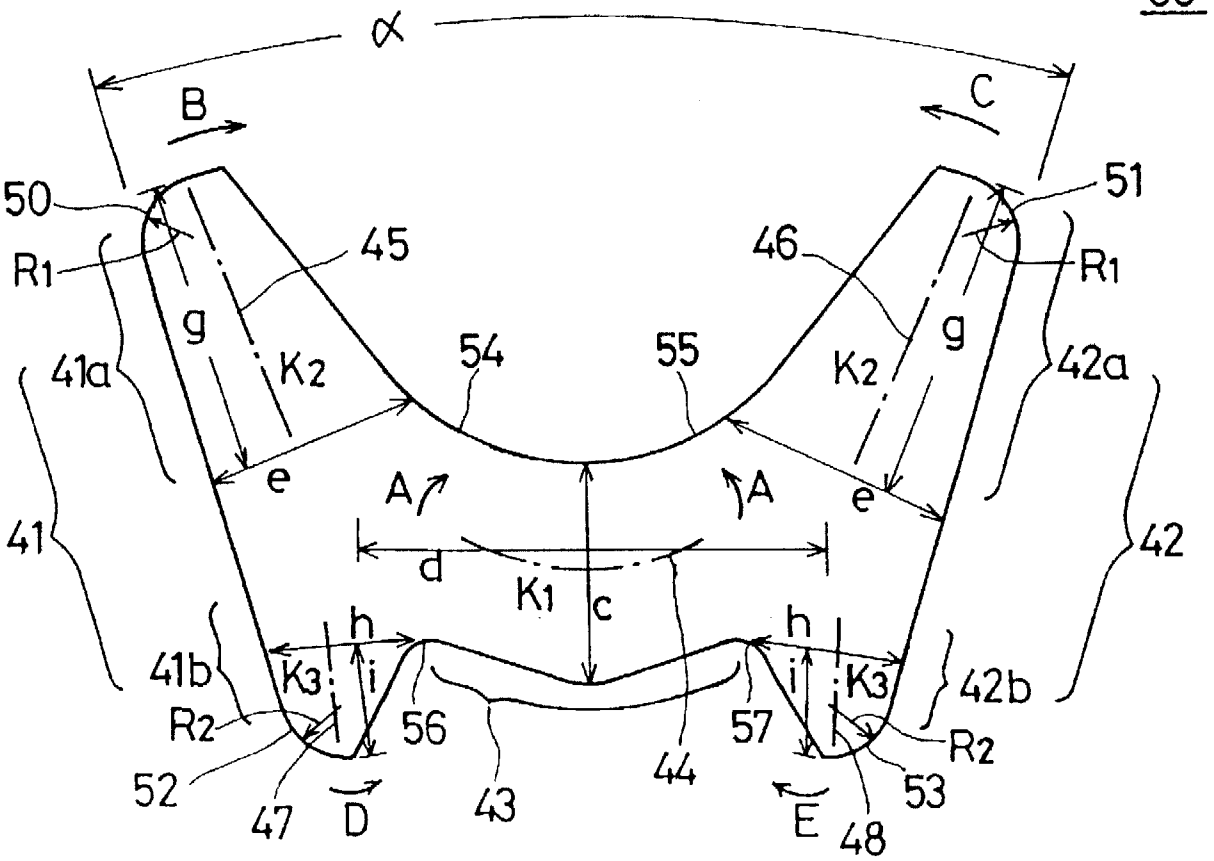
FIG. 6 is an enlarged cross-sectional view of the press-fitting portion taken along a line VI—VI of FIG. 4.

FIG. 6 shows a cross-sectional view of the press-fitting portion 33 of the press-fit pin 30, the cross-sectional view being perpendicular to a longitudinal axis of the press-fit pin 30. The cross section of the press-fitting portion 33 has a symmetrical shape as shown in FIG. 6.

The press-fitting portion 33 has beam portions 41 and 42 on both sides, respectively, and has a cross portion 43 connecting the beams 41 and 42 at their lower ends. The cross portion 43 is formed in a convexo-concave shape a top of which is concave. A chain line 44 in the cross portion 43 of FIG. 6 indicates a center line.

The cross portion 43 has a width c and a length d, and can be elastically bent, with a spring constant K1, in directions indicated by arrows A. The beams 41 and 42 are formed so that they form an upper portion of a V having an angle a of approximately 30 degrees.

The beam 41 has a larger beam **41*a* and a smaller beam 41*b*, both extending from the cross portion 43. The larger beam 41*a* extends upwardly, and a portion adjacent to the cross section 43 is wider than an end thereof. The smaller beam 41*b* extends downwardly, and a portion adjacent to the cross section 43 is wider than an extreme end thereof. Similarly to the beam 41, the beam 42 has a larger beam 42*a* and a smaller beam 42*b*, both extending from the cross portion 43. The larger beam 42*a* extends upwardly, and a portion adjacent to the cross section 43 is wider than an end thereof. The smaller beam 42*b* extends downwardly, and a portion adjacent to the cross section 43** is wider than an extreme end thereof.

The larger beams **41*a* and 42*a* have a length g which is considerably greater than a length i of the smaller beams 41*b* and 42*b*. The larger beams 41*a* and 42*a* have a width e at their root, and can be elastically bent, with a spring constant of K2, in directions indicated by arrows B and C, respectively. The smaller beams 41*b* and 42*b*** have a width h at their root, and can be elastically bent, with a spring constant of K3, in directions indicated by arrows D and E, respectively.

That is, all structural elements of the press-fitting portion 33 can be elastically bent. In other words, the press-fitting portion 33 has five portions which can be elastically bent.

It should be noted that chain lines 45 and 46 indicate center lines of the larger beams **41*a* and 42*a*, respectively. Chain lines 47 and 48 are center lines of the smaller beams 41*b* and 42*b***, respectively.

The above-mentioned dimensions are determined, for example, to satisfy the following relationship.

$$e=2h,\ e \geqq c$$

Accordingly, the spring constants K1, K2 and K3 have the following relationship.

$$K2<K1<K3$$

Because the spring constants K1, K2 and K3 are in the above-mentioned relationship, when forces are applied to an end of each of the larger beams **41*a* and 42*a* in directions indicated by the arrows B and C, respectively, the larger beams 41*a* and 42*a* begin to bend first, and the cross portion 43 secondly begins to bend in the directions indicated by the arrows A. That is, the press-fitting portion 33** is so constructed that parts begin to bent stepwisely.

Additionally, the larger beam 41a and 42a have rounded contacting portions 50 and 51, respectively, on their extreme ends. The contacting portions 50 and 51 have a radius of curvature R1 of 0.1 mm. This radius R1 is considerably greater than a radius of the conventional press-fit pin which radius is only about 0.04 mm. The larger beams 41a and 42a are connected to the cross portion 43 with gently curved portions 54 and 55. The smaller beams 41b and 42b are connected to the cross portion 43 with gently curved portions 56 and 57. The dimensions of the press-fitting portion 33 has a tolerance the same as that of the conventional press-fit pins.

A description will now be given, with reference to FIGS. 7A, 7B and 7C, of conditions in which the press-fitting portion 33 is press fit into the through hole. The through holes 60, 61 and 62 shown in FIGS. 7A, 7B and 7C have a diameter of 0.48 mm, which is expected to be used in the near future, with a tolerance of ±0.04 mm. The through hole 60 shown in FIG. 7A has an exact diameter d1=0.48+0.04 mm. The through hole 61 shown in FIG. 7B has an exact diameter d2=0.48 mm. The through hole 62 shown in FIG. 7C has an exact diameter d3=0.48−0.04 mm. Chain lines from 44a, 44b and 44c through 48a, 48b and 48c indicate center lines of corresponding parts of the press-fitting portion 33.

Figure 7A:
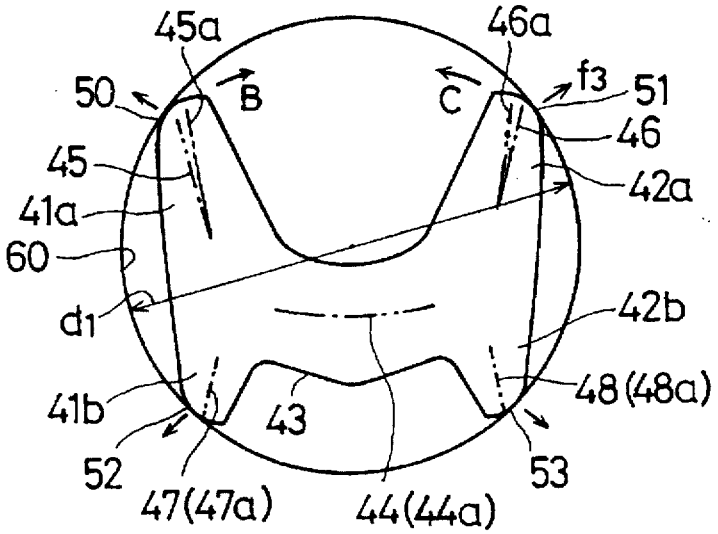
FIGS. 7A, 7B and 7C are cross-sectional views of the press-fitting portion shown in FIG. 4 in a state where the press-fitting portion is press fit into a through hole.

FIG. 7A shows a state where the press-fitting portion 33 is press fit into the through hole 60 which has a maximum diameter. In this condition, the larger beams 41a and 42a are elastically bent in the directions indicated by the arrows B and C, respectively. However, the cross portion 43 and the smaller beams 41b and 42b are not bent yet. Accordingly, the press-fitting portion 33 is bent at two portions, that is, a bending stress in the press-fitting portion 33 is dispersed in two portions. In this state, each of the contacting portions 50 through 53 presses the inner surface of the through hole 60 by a force f3, and thus the press-fitting portion 33 is held in the through hole 60 by a predetermined force.

Figure 7B:
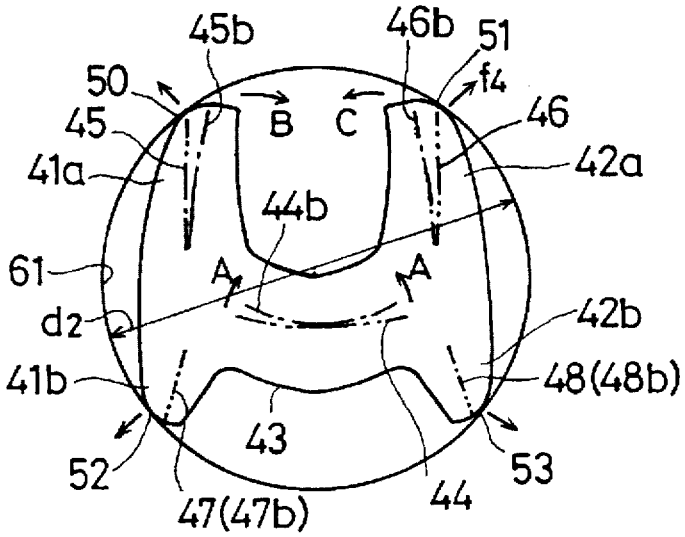

FIG. 7B shows a state where the press-fitting portion 33 is press fit into the through hole 61 which has a medium diameter. In this condition, the larger beams 41a and 42a are elastically bent in the directions indicated by the arrows B and C, respectively, farther than that shown in FIG. 7A. The cross portion 43 is also bent in the directions indicated by the arrows A. However, the smaller beams 41b and 42b are not bent yet. Accordingly, the press-fitting portion 33 is bent at three portions, that is, a bending stress in the press-fitting portion 33 is dispersed in three portions. In this state, each of the contacting portions 50 through 53 presses the inner surface of the through hole 60 by a force f4, and thus the press-fitting portion 33 is held in the through hole 61 by a predetermined force.

Figure 7C:
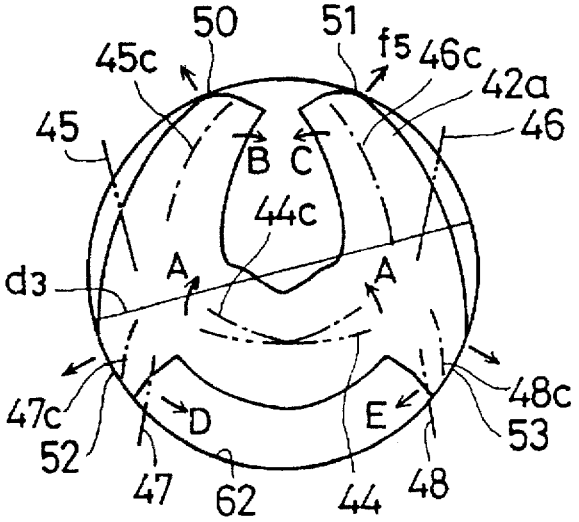

FIG. 7C shows a state where the press-fitting portion 33 is press fit into the through hole 62 which has a minimum diameter. In this condition, the larger beams 41a and 42a are elastically bent in the directions indicated by the arrows B and C, respectively, farther than that shown in FIG. 7B. The cross portion 43 is also bent in the directions indicated by the arrows A farther than that shown in FIG. 7B. Additionally, the smaller beams 41b and 42b are bent in the directions indicated by the arrows D and E, respectively. Accordingly, the press-fitting portion 33 is bent at five portions, that is, a bending stress in the press-fitting portion 33 is dispersed in five portions.

In this condition, the smaller beams 41b and 42b are bent in the directions indicated by the arrows D and E, respectively, because an outward movement of the smaller beams 41b and 42b is blocked by the inner surface of the through hole 62, the outward movement being generated due to the bending of the larger beams 41a and 42a and the cross portion 43.

Due to the bending of the smaller beams 41b and 42b, amounts of the bent of the larger beams 41a and 41b and the cross portion 43 are less than that in a condition where the smaller beams 41b and 42b are not bent. Accordingly, even if the through hole has a minimum diameter in its tolerance, the bending of the larger beams 41a and 42a and the cross portion 43 does not reach the yield point, and thus a large margin is provided before the fracture point is reached. Therefore, the press-fitting portion 33 of the present embodiment does not fracture even if it is press fit into a minimum through hole.

In this state, each of the rounded contacting portions 50 through 53 presses the inner surface of the through hole 62 by a force f5, and thus the press-fitting portion 33 is held in the through hole 62 by a predetermined force.

Figure 8:
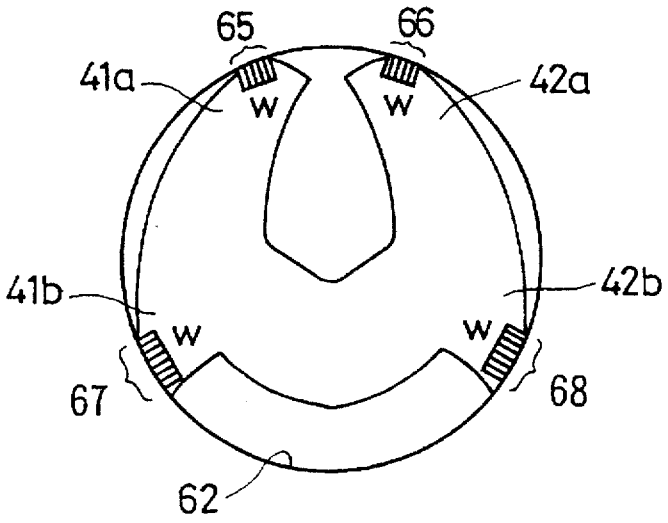
FIG. 8 is an illustration for explaining forces exerted by beam portions.

A description will now be given, with reference to FIG. 8, of an action of the rounded contacting portions 50 to 53 which have a radius greater than that of the conventional press-fit pin. FIG. 8 shows a state the same as that shown in FIG. 7C.

Since each of the rounded contacting portions 50 to 53 has a radius greater than that of the conventional press-fit pin, contacting areas 65 to 68 between the contacting portions 50 to 53 and the inner surface of the through hole 62 are wider than that obtained by the conventional one. The larger beams 41a and 42a and the smaller beams 41b and 42b each receives a respective bending force from the contacting areas 65 to 68 in directions indicated by arrows A, B, C and D of FIG. 7, respectively. Since the contacting areas 65 to 68 are wide, each of the forces exerted on the rounded contacting areas 65 to 68 is not a concentrated load but a dispersed load W. Accordingly, the bending stress is also dispersed within each of the larger and smaller beams 41a, 42a, 41b and 42b, and thus the bending of each of the larger and smaller beams 41a, 42a, 41b and 42b is maintained further below the yield point.

A description will now be given of action of the gently curved portions 54 to 57 shown in FIG. 6. The curved portions 54 and 55 are provided so as to prevent a concentration of a bending stress generated in an area adjacent to the root of each of the larger beams 41a and 42a. The curved portions 56 and 57 are provided so as to prevent a concentration of a bending stress generated in an area adjacent to the root of each of the small beams 41b and 42b.

A description will now be given, with reference to FIG. 9, of a second embodiment of a press-fit pin according to the present invention. The second embodiment of the press-fit pin according to the present invention has the same structure as the first embodiment except for a press-fitting portion 80 shown in FIG. 9. The press-fitting portion 80 of the second embodiment shown in FIG. 9 is formed in a shape the same as that of the press-fitting portion 33 shown in FIG. 6 except that the press-fitting portion 80 does not have the smaller beams.

The press-fitting portion 80 is formed by press machining, and has beams 81 and 82 on both sides, respectively, and has a cross portion 83 connecting the beams 81 and 82 at their lower ends. The beams 81 and 82 are formed so that they form an upper portion of a V having an angle β of approximately 30 degrees.

Figure 9:
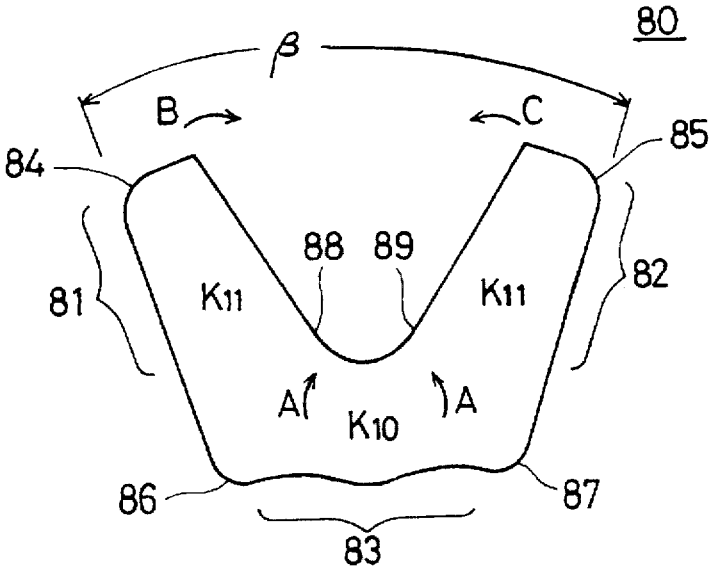
FIG. 9 is an enlarged cross-sectional view of a press-fitting portion of a second embodiment of a press-fit pin according to the present invention.

The cross portion 83 can be elastically bent, with a spring constant K10, in directions indicated by arrows A in FIG. 9. The beams 81 and 82 can be elastically bent, with a spring constant of K11, in directions indicated by arrows B and C, respectively. Accordingly, the press-fitting portion 80 has three portions which are to be elastically bent.

Dimensions of the beam portions 81 and 82 and the cross portion 83 are appropriately determined so that the spring constant K10 and K11 have a relationship represented by K11<k10. Accordingly, when forces are applied to an end of each of the beams 81 and 82 in directions indicated by the arrows B and C, respectively, the beams 81 and 82 begin to bend first, and the cross portion 83 secondly begins to bend in the directions indicated by the arrows A. That is, the press-fitting portion 80 is so constructed that parts are bent stepwisely.

The beam 81 and 82 have rounded contacting portions 84 and 85, respectively, on their extreme ends. The rounded contacting portions 84 and 85 have a radius of curvature of 0.1 mm. Additionally, the cross portion 83 has contacting portions 86 and 87 on opposite sides, the contacting portions 86 and 87 having a radius of curvature of 0.1 mm. Similarly to the rounded contacting portions 50 to 57 of the first embodiment, the contacting portions 84 to 87 act to disperse a load exerted on each of the beams 81 and 82 and the cross portion 83.

The beams 81 and 82 are connected to the cross portion 83 via gently curved portions 88 and 89, respectively. Similarly to the curved portions 54 and 55 of the first embodiment, the curved portions 88 and 89 act to prevent a concentration of a bending stress generated in an area adjacent to a root of each of the beams 81 and 82.

Figure 10A:
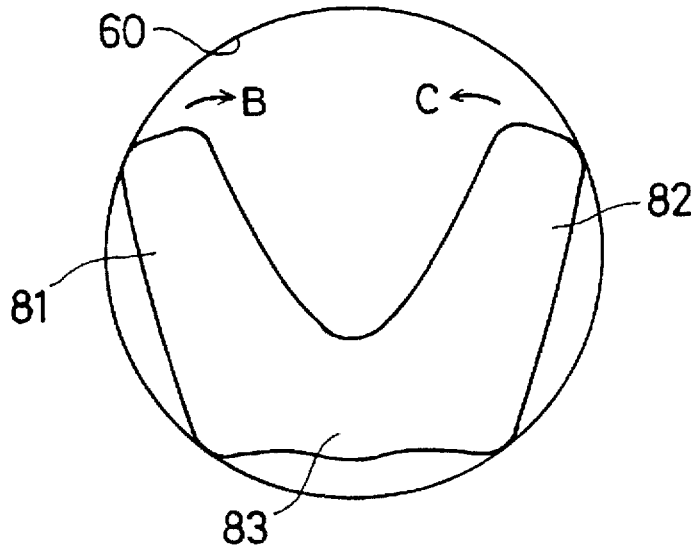
FIGS. 10A, 10B and 10C are cross-sectional views of the press-fitting portion shown in FIG. 9 in a state where the press-fitting portion is press fit into a through hole.
Figure 10B:
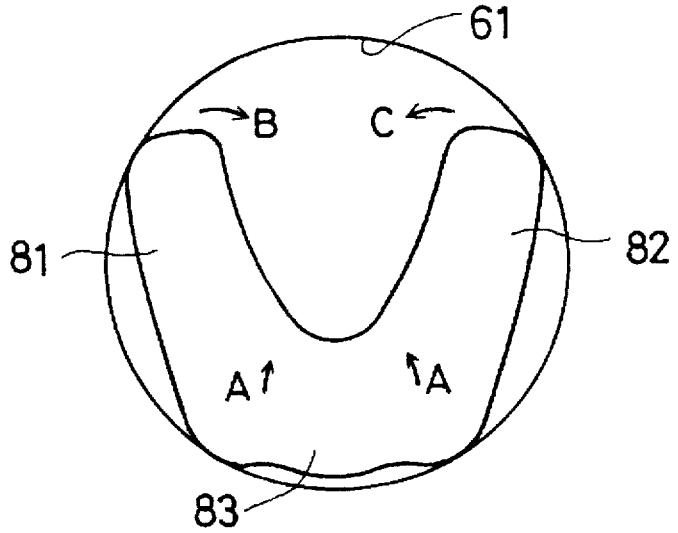
Figure 10C:
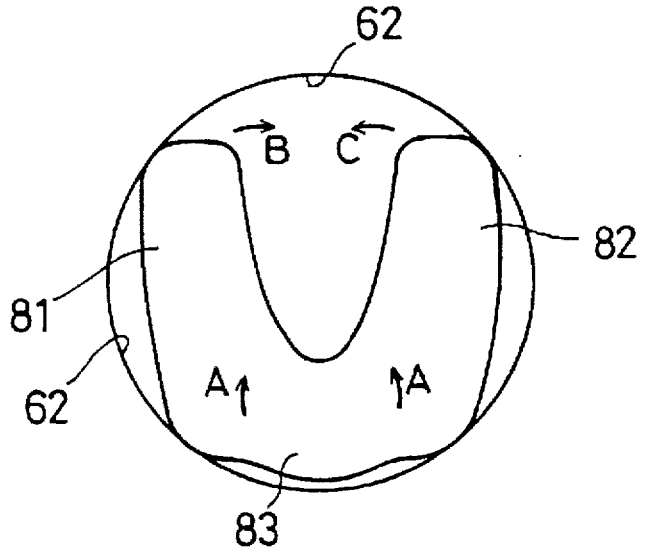

The press-fitting portion 80 is press fit into a through hole as shown in FIGS. 10A, 10B and 10C. It should be noted that FIGS. 10A, 10B and 10C correspond to FIGS. 7A, 7B and 7C.

FIG. 10A shows a state where the press-fitting portion 80 is press fit into the through hole 60 which has a maximum diameter. In this condition, the beams 81 and 82 are elastically bent in the directions indicated by the arrows B and C, respectively. However, the cross portion 83 is not bent yet. Accordingly, the press-fitting portion 80 is bent at two portions, that is, a bending stress in the press-fitting portion 80 is dispersed in two portions.

FIG. 10B shows a state where the press-fitting portion 80 is press fit into the through hole 61 which has a medium diameter. In this condition, the beams 81 and 82 are elastically bent in the directions indicated by the arrows B and C, respectively, farther than that shown in FIG. 10A. The cross portion 83 is also bent in the directions indicated by the arrows A. Accordingly, the press-fitting portion 80 is bent at three portions, that is, a bending stress in the press-fitting portion 80 is dispersed in three portions.

FIG. 10C shows a state where the press-fitting portion 80 is press fit into the through hole 62 which has a minimum diameter. In this condition, the beams 81 and 82 are elastically bent in the directions indicated by the arrows B and C, respectively, farther than that shown in FIG. 10B. The cross portion 83 is also bent in the directions indicated by the arrows A farther than that shown in FIG. 10B. The press-fitting portion 80 is bent at three portions, that is, a bending stress in the press-fitting portion 80 is dispersed in three portions.

Due to the bending of the cross portion 83, amounts of the bending of the beams 81 and 82 are less than that in a condition where the cross portion 83 is not bent. Accordingly, even if the through hole has a minimum diameter in its tolerance, the bending of the beams 81 and 82 does not reach the yield point, and thus a large margin is provided before the fracture point is reached. Therefore, the press-fitting portion 80 of the present embodiment does not fracture even if it is press fit into the minimum through hole.

Figure 11:
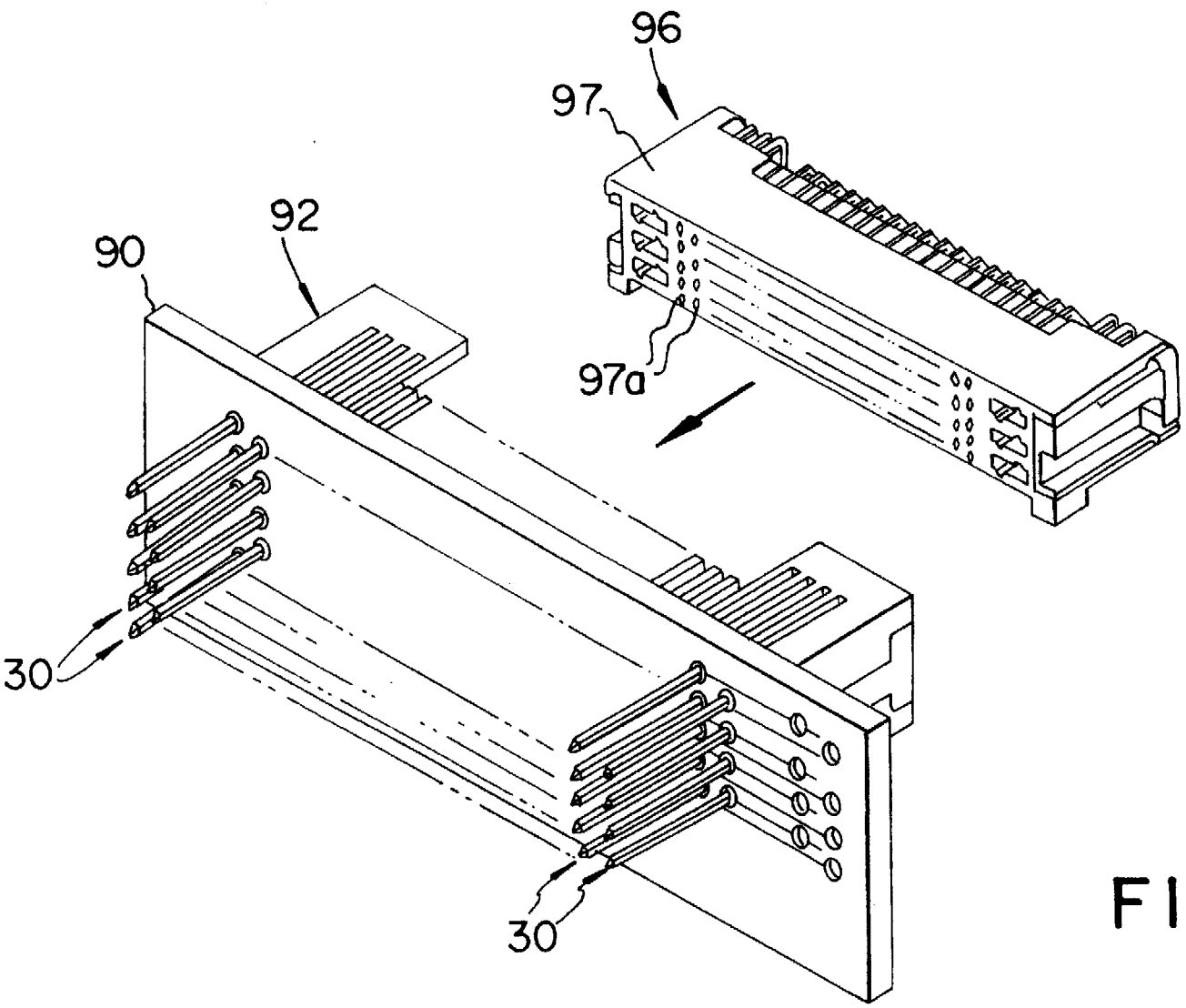
FIG. 11 is a perspective view of a plug having the press-fit pins according to the present invention and a jack connector to be connected to the plug.

A description will now be given, with reference to FIGS. 11 and 12, of an application of the press-fit pin according to the present invention. FIG. 11 is a perspective view of a plug having the press-fit pins according to the present invention and a jack connector to be connected to the plug.

As shown in FIG. 11, the press-fit pin 30 according to the present invention is used for a plug 92 which fits to a jack connector 96. The plug 92 and the jack connector 96 together connect a circuit formed on a circuit board 90 (only a part is shown in the figure) to an external circuit (not shown in the figure) connected to the jack connector 96. The jack connector 96 comprises a jack body 97 having a plurality of insertion holes 97*a* each of which fits to a contacting portion 31 (refer to FIG. 3) of a respective press-fit pin 30.

Figure 12:
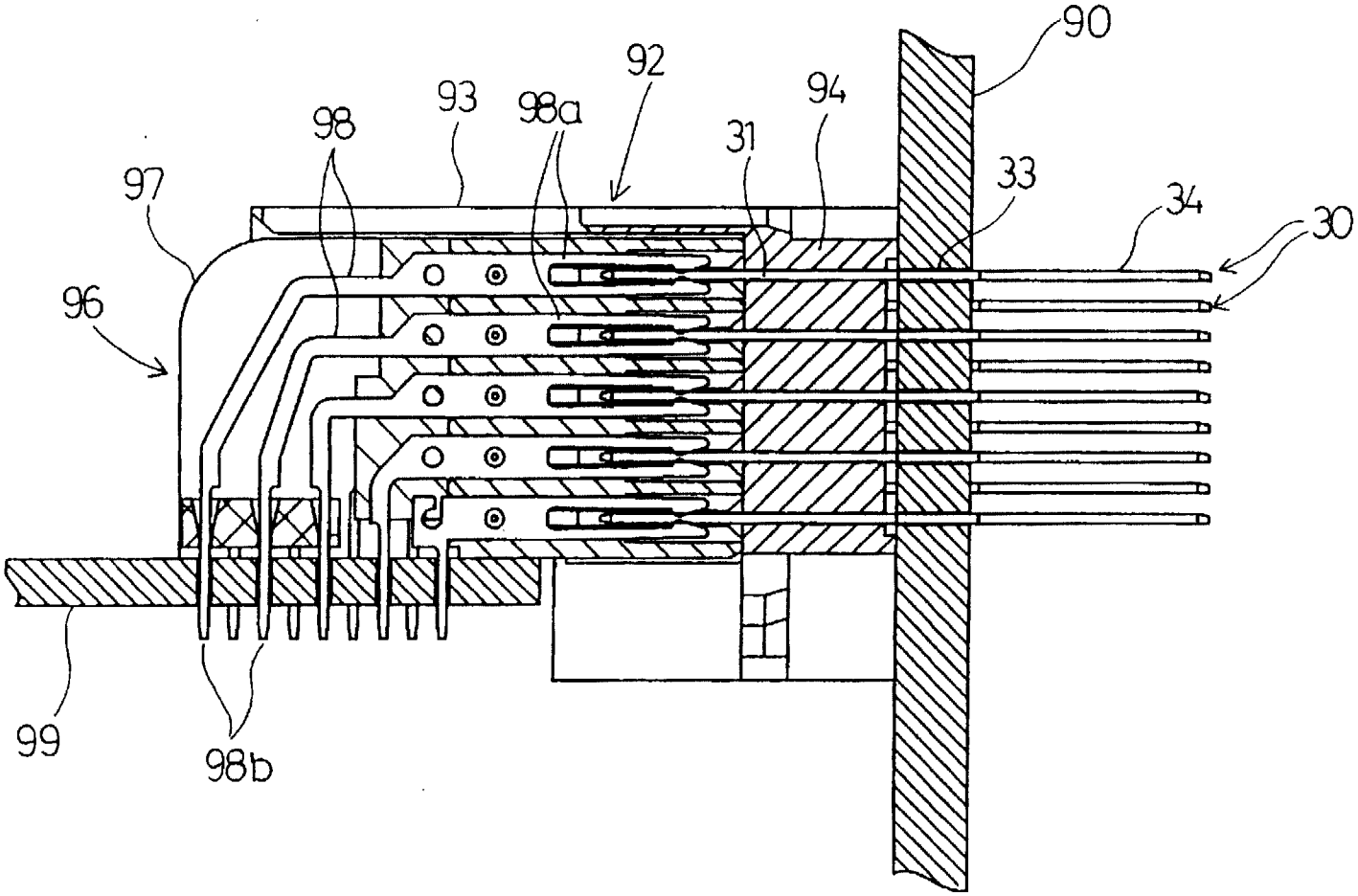
FIG. 12 is a cross-sectional view of the plug and the jack connector shown in FIG. 11 in a state in which the jack connecter is connected to the plug.

FIG. 12 is a cross-sectional view of the plug and the jack connector shown in FIG. 11 in a state in which the jack connecter is connected to the plug. The plug 92 comprises a plug body 93 and an insulator 94 which isolates the contacting portions 31 of the press-fit pins 30 mounted on the circuit board 90. An end of each of the contacting portions 31 protrudes from the insulator 94 so as to be inserted into the respective insertion hole 97*a* of the jack body 97. The insulator 94 may be mounted on the circuit board 90 before the press-fit pins 30 are press fit in through holes of the circuit board 90, or may be mounted after the press-fit pins 30 have mounted on the circuit board 90.

The jack connector 96 has a plurality of contact members 98, an end 98*a* of each of the contact member being fit in the insertion hole 97*a* and the other end 98*b* projecting from a surface of the jack body 97. The jack connector 96 shown in FIG. 12 is a right-angle type, and thus the end 98*a* of each of the contact members 98 extends in a direction perpendicular to an extending direction of the other end 98*b* which is connected to a circuit board 99 by suitable means such as soldering.

In a state in which the jack connector 96 is connected to the plug 92 provided on the circuit board 90, an end of the contacting portion 31 of the press-fit pin 30 fits to the end 98*a* of the contact member 98 in the insertion hole 97*a*, and thus each of the contact pins 30 mounted on the circuit board 90 is electrically connected to the respective contact members 98 connected to the circuit board 99. Accordingly, a circuit formed on the circuit board 99 is connected to a circuit formed on the circuit board 90. Since each of the press-fit pins 30 are securely mounted on the circuit board 90 as mentioned before, the jack connector 96 and thus the circuit board 99 can be securely mounted on the circuit board 90.

The present invention is not limited to the specifically disclosed embodiments, and variations and modifications may be made without departing from the scope of the present invention.

What is claimed is:

1. A press-fit pin having a press-fitting portion to be press fit into a through hoe, said press-fitting portion comprising:

a first beam extending along a longitudinal axis of said press-fitting portion; said first beam having a first larger beam and a first smaller beam, each of which is elastically bent along a line parallel to the longitudinal axis of said press-fitting portion when said press-fitting portion is press fit into said through hole;

a second beam extending along the longitudinal axis of said press-fitting portion, said second beam having a second larger beam and a second smaller beam, each of which is elastically bent along a line parallel to the longitudinal axis of said press-fitting portion when said press-fitting portion is press fit into said through hole; and a cross portion extending along the longitudinal axis of said press-fitting portion so as to connect said first beam and said second beam, said cross portion being elastically bent along a line parallel to the longitudinal axis of said press-fitting portion when said press-fitting portion is press fit into said through hole, said cross portion having a substantially uniform thickness;

wherein said first beam is connected to said second beam with said cross portion therebetween so that said second beam is symmetric with said first beam with respect to a line including the longitudinal axis of said press-fitting portion, said first larger beam and said second larger beam extending upward from said cross portion so as to form an upper portion of a V, said first smaller beam and said second smaller beam extending downward from said cross portion.

2. The press-fit pin as claimed in claim 1, wherein said cross portion has a first spring constant K1, said first and second larger beams have a second spring-constant K2 and said first and second smaller beams have a third spring-constant K3, and wherein said first, second and third spring-constants have a relationship represented by $K2<K1<K3$.

3. The press-fit pin as claimed in claim 1, wherein each of said first and second beams is connected to said cross portion with a gentle curve so that a stress generated in an area adjacent to a root of each of said first and second beams is not concentrated.

4. The press-fit pin as claimed in claim 1, wherein each of said first and second larger beams and said first and second smaller beams has a rounded contacting portion to be contacted to an inner surface of said through hole, a radius of curvature of said round portion being determined so that a load exerted on said round portion is dispersed.

5. The press-fit pin as claimed in claim 4, wherein the radius of curvature of said rounded contacting portion is 0.1 mm.

6. A connecting construction of a circuit formed on a circuit board to another circuit, said connecting construction comprising:

a first circuit board on which a first circuit is formed;

at least one press-fit pin press fit in a through hole formed in said first circuit board, said press-fit pin having a contacting portion being connected to said first circuit, and a press-fitting portion;

said press-fitting portion comprising:

a first beam extending along a longitudinal axis of said press-fitting portion, said first beam having a first larger beam and a first smaller beam, each of which is elastically bent along a line parallel to the longitudinal axis when said press-fitting portion is press fit into said through hole, a second beam extending along the longitudinal axis of said press-fitting portion, said second beam having a second larger beam and a second smaller beam, each of which is elastically bent along a line parallel to the longitudinal axis when said press-fitting portion is press fit into said through hole, and a cross portion extending along the longitudinal axis of said press-fitting portion so as to connect said first beam and said second beam, said cross portion being elastically bent along a line parallel to the longitudinal axis when said press-fitting portion is press fit into said through hole, wherein said first beam is connected to said second beam with said cross portion therebetween so that said second beam is symmetric with said first beam with respect to a line including the longitudinal axis of said press-fitting portion, said first larger beam and said second larger beam extending upward from said cross portion so as to form an upper portion of a V, said first smaller beam and said second smaller beam extending downward from said cross portion;

wherein each of said first and second beams has a first spring constant, and said cross portion has a second spring constant different from said first spring constant and a substantially uniform thickness; and a jack connector having a first surface and a second surface facing different direction from said first surface, at least one insertion hole corresponding to said press-fit pin being formed on said first surface into which insertion hole an end of said press-fit pin is inserted, said jack connector comprising at least one contact member of which one end is accommodated in said insertion hole and the other end protrudes form said second surface, said one end of said contact member contacting to said end of said press-fit pin when said press-fit pin is inserted into said insertion hole.

7. The connecting construction as claimed in claim 6, further comprising an insulator which isolates and insulates said press-fit pin mounted on said first circuit board, said end of said press-fit pin protruding from said insulator so that said end of said press-fit pin is inserted into said insertion hole when said jack connector is fit on said press-fit pin.

8. The connecting construction as claimed in claim 6, further comprising a second circuit board connected to said second surface of said jack connector so that a second circuit formed on said second circuit board is connected to said first circuit formed on said first circuit board via said contact member and said press-fit pin.

* * * * *